United States Patent [19]

Wilcox

[11] 3,982,498

[45] Sept. 28, 1976

[54] DEVELOPMENT APPARATUS

[75] Inventor: David G. Wilcox, West Webster, N.Y.

[73] Assignee: Xerox Corporation, Stamford, Conn.

[22] Filed: Mar. 26, 1975

[21] Appl. No.: 562,290

Related U.S. Application Data

[62] Division of Ser. No. 416,898, Nov. 19, 1973, Pat. No. 3,915,121.

[52] U.S. Cl. ..... 118/637; 355/3 DD; 427/18

[51] Int. Cl.[2] ..... G03G 15/08

[58] Field of Search ..... 118/637, 621, 623, 639; 355/3 DD; 427/18

[56] References Cited

UNITED STATES PATENTS

| | | | |
|---|---|---|---|
| 2,892,446 | 6/1959 | Olden | 118/637 |
| 2,904,000 | 9/1959 | Fisher et al. | 118/637 |
| 2,910,964 | 11/1959 | Stavrakis et al. | 118/637 |
| 3,058,444 | 10/1962 | Sugarman, Jr. et al. | 118/637 |
| 3,133,834 | 5/1964 | Sowiak | 118/637 |
| 3,648,656 | 3/1972 | Ogawa | 118/637 |
| 3,753,420 | 8/1973 | Post et al. | 118/637 |
| 3,754,526 | 8/1973 | Caudill | 118/637 |
| 3,822,139 | 7/1974 | Westdale | 118/637 |

*Primary Examiner*—Mervin Stein
*Assistant Examiner*—Douglas Salser
*Attorney, Agent, or Firm*—Paul Weinstein; Clarence A. Green; James J. Ralabate

[57] ABSTRACT

A development apparatus for developing electrostatic images upon a moving image-bearing surface including flow baffle means for regulating the flow of developer to the development zone. The baffle means is positioned between a supply means and the development zone and extends inwardly of each of the ends of a development means which preferably comprises a magnetic brush. The baffle means comprises stationary magnetic brushes formed of developer material. The stationary magnetic brushes are adapted to limit the flow of developer at the end portions of the development means.

17 Claims, 10 Drawing Figures

DEVELOPMENT APPARATUS

This is a division of application Ser. No. 416,898, filed Nov. 19, 1973 now U.S. Pat. No. 3,915,121.

BACKGROUND OF THE INVENTION

This invention relates to a development apparatus for developing electrostatic images upon a moving image-bearing surface. Flow baffle means are included for regulating the flow of developer to the development zone. The flow baffle means comprise stationary magnetic brushes.

In prior art magnetic brush development apparatuses, a problem has occurred with respect to the copy quality output of the electrostatic reproducing machines in which they are employed. In some machines a high background region is formed on each of the end portions of the copy sheet due to higher flow rates of developer at the end portions of a magnetic brush development means. The higher flow rates at the ends of the magnetic brush development means are due at least in part to the presence of fringe fields at the ends of the brush forming magnets within the development means which attract an increased amount of developer to the ends of the magnetic roll. The increased flow of developer coupled with fringe fields at the ends of the magnetic brush roll results in a higher density of developer at the ends of the roll and, therefore, a consequent increase in the background level on the end portions of the copy sheet.

In U.S. Pat. Nos. 3,648,656, granted Mar., 1972, and 3,754,526, granted Aug., 1973, there are disclosed magnetic brush evelopment apparatuses wherein magnetic field generating means are employed to prevent the developer from being picked up by the end portions of the magnetic brush rolls. These patents use magnetic fields to control the flow of developer, but do not employ stationary magnetic brushes in accordance with this invention to mechanically control the flow of developer.

The use of a magnetic means interposed between a bearing and a flow of magnetic particles is described in U.S. Pat. No. 2,996,162, granted August, 1961, and in U.S. application Ser. No. 266,905, filed June 28, 1972. In these devices a magnetic flux field produced by the magnetic means entraps and aligns the magnetic granules into a brush which acts to seal the bearings from the flow of magnetic particles. The patent and application do not use the magnetic seal brushes as flow baffles to regulate the flow of developer to the development zone of a development apparatus.

SUMMARY OF THE INVENTION

In accordance with this invention, a development apparatus is provided for developing electrostatic images upon a moving image-bearing surface at a development zone by the application of developer thereto. The development apparatus includes a developer supply means and a development means for applying developer to the image-bearing surface. The development means extends across the image-bearing surface and has first and second opposing ends and first and second end portions extending inwardly from the housing. The development means is adapted to move between the supply means and the development zone.

In accordance with this invention flow baffle means are provided for regulating the flow of developer to the development zone. The baffle means are positioned between the supply means and the development zone and extend inwardly of each of the ends of the development means and have a limited extension in the direction of movement of the development means. The baffle means, in accordance with this invention, comprise stationary magnetic brushes which are effective to limit the flow of developer at the end portions of the development means.

Preferably, in accordance with this invention, the development apparatus comprises a magnetic brush development apparatus and the development means includes a magnetic brush support means, means for forming a magnetic brush of developer upon the support means, and means for moving the support means between the supply means and the development zone.

The stationary magnetic brush flow baffles of this invention are preferably formed by means of a magnetic field generated externally of the development means. The magnetic field generating means preferably comprises a permanent magnet and most preferably a magnet having a wedge shape to provide a less abrupt flow rate disturbance. To provide a further improvement in developer flow regulation at the ends of the development means, mechanical flow blocks separate from the stationary brush flow baffles can be employed which are positioned between the flow baffles and the supply means.

Accordingly, it is an object of his invention to provide a development apparatus including stationary magnetic brush flow baffle means to regulate the flow of developer to the development zone.

It is a further object of this invention to provide a development apparatus as above which comprises a magnetic brush development apparatus.

It is a still further object of this invention to provide a reproducing apparatus employing the above-noted development apparatus.

These and other objects of the invention will become more apparent to those skilled in the art from the following description and drawings.

DETAILED DESCRIPTION OF THE PREFERRED EMBODIMENTS

Figure 1:
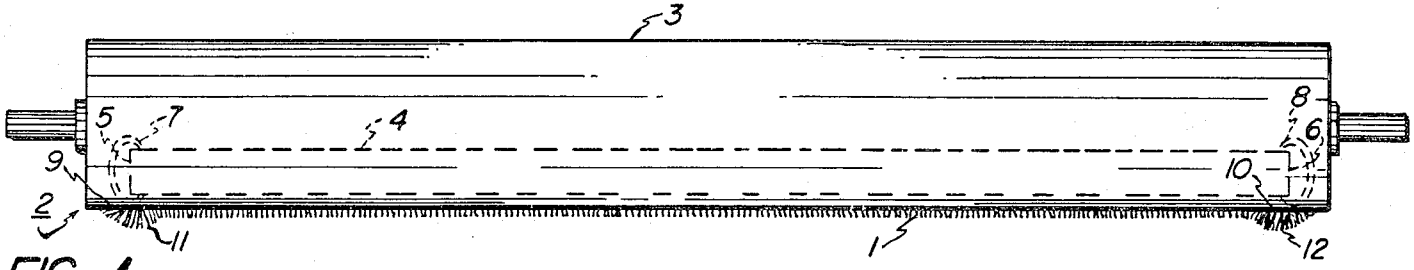
FIG. 1 shows a top view in partial cross-section of a prior art magnetic brush development means.

Referring to FIG. 1, there is shown a magnetic brush 1 formed in accordance with a prior art magnetic brush roll design 2. The magnetic brush roll 2 comprises a cylindrical shell 3 which has a stationary magnet 4 supported within it, which is adapted to orient and form a developer mix into a magnetic brush 1 for application to an electrostatic image on a moving image-bearing surface. A generally normal field is provided along the length of the magnet 4 except at the ends 5 and 6 where fringe fields 7 and 8 are formed which have an additive effect with the normal field to provide stronger magnetic fields at the ends of the magnet. This results in an increased amount of developer being picked up at the end portions 9 and 10 of the mag brush roll 2 so that the resulting magnetic brush 1 prior to contacting the image-bearing plate has a cross-section substantially as shown. The increased amount of developer material which goes into the portions 11 and 12 of the brush 1 at the ends of the roll 2 results in a marked increase in developer flow at these portions and a consequent reduction in developer life. Besides reducing developer life the increased flow rates at the end portions 9 and 10 of the roll 2 coupled with the fringe fields 7 and 8, have a deleterious effect on copy quality. When the brush 1 contacts the image-bearing surface, the bulbous portions 11 and 12 of the brush are compacted such that they have an increased developer density. As a result, a greater portion of background is developed by the end portions 11 and 12 of the magnetic brush 2 which when transferred to the final support sheet gives an undesirably high background appearance at each of the ends of the ends of the sheet.

Figure 2:
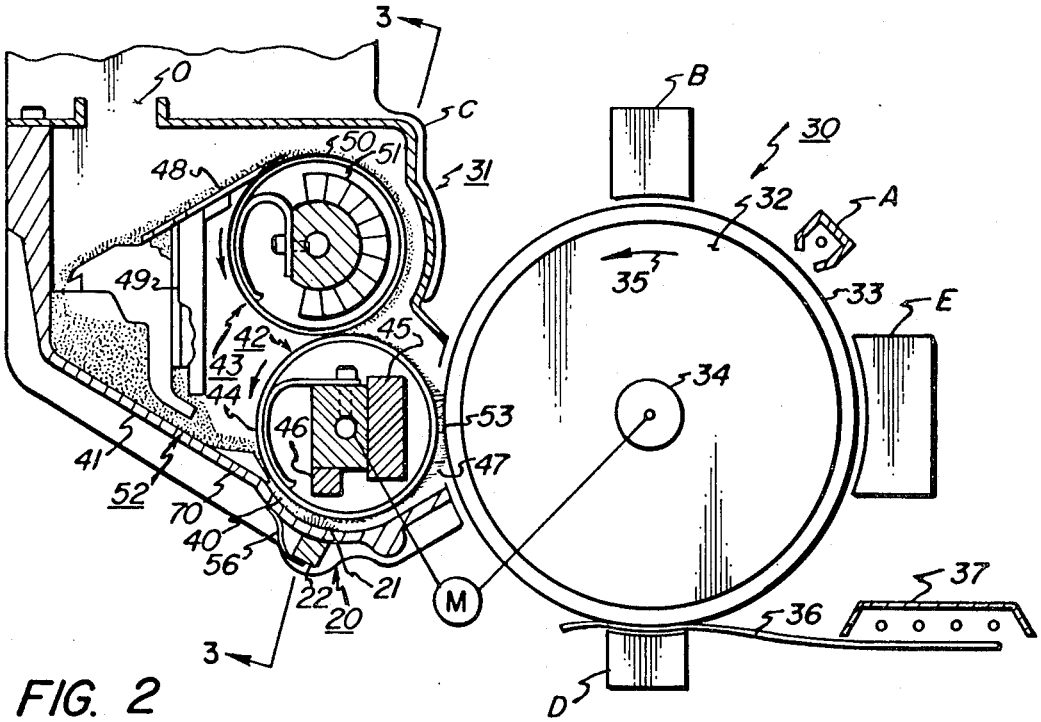
FIG. 2 shows a schematic view in partial cross-section of an electrostatographic reproducing machine in accordance with this invention.

In order to reduce the developer flow rates at the end portions 9 and 10 of the magnetic brush roll 2 in accordance with this invention as shown in FIG. 2, baffle flow means 20 are provided which comprise stationary magnetic brushes 21 which are effective to regulate the flow of developer at the end portions 9 and 10 of the roll 2.

Referring now to FIG. 2 there is shown by way of example an automatic xerographic reproducing machine 30 which incorporates the magnetic brush flow baffles 20 and magnetic brush apparatus 31 of the present invention. The reproducing machine 30 depicted in FIG. 1 illustrates the various components utilized therein for producing copies from an original. Although the magnetic brush flow baffles 20 and magnetic brush apparatus 31 of the present invention are particularly well adapted for use in an automatic xerographic reproducing machine 30, it should become evident from the following description that they are equally well suited for use in a wide variety of processing systems including other electrostatographic systems and they are not necessarily limited in their application to the particular embodiment or embodiments shown herein.

The reproducing machine 30 illustrated in FIG. 2 employs an image recording drum-like member 32, the outer periphery of which is coated with a suitable photoconductive material 33. One type of suitable photoconductive material is disclosed in U.S. Pat. No. 2,970,906, issued to Bixby in 1961. The drum 32 is suitably journaled for rotation within a machine frame (not shown) by means of shaft 34 and rotates in the direction indicated by arrow 35 to bring the image-bearing surface 33 thereon past a plurality of xerographic processing stations. Suitable drive means M are provided to power and coordinate the motion of the various cooperating machine components whereby a faithful reproduction of the original input scene information is recorded upon a sheet of final support material 36 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

The various processing stations for producing a copy of an original are herein represented in FIG. 2 as blocks A to E. Initially, the drum 32 moves the photoconductive surface 33 through a charging station A. In the charging station A, an electrostatic charge is placed uniformly over the photoconductive surface 33 preparatory to imaging. The charging may be provided by a corona generating device of the type described in U.S. Pat. No. 2,836,725, issued to Vyverberg in 1958.

Thereafter, the drum 32 is rotated to exposure station B wherein the charged photoconductive surface 33 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al. in 1962. After exposure drum 32 rotates the electrostatic latent image recorded on the photoconductive surface 33 to development station C in accordance with the invention wherein a conventional developer mix is applied to the photoconductive surface 33 of the drum 32 rendering the latent image visible. A suitable development station is disclosed in U.S. Pat. No. 3,707,947, issued to Reichart in 1973. That patent describes a magnetic brush development system utilizing a magnetizable developer mix having ferromagnetic carrier granules and a toner colorant. The developer mix is brought through a directional flux field to form a brush thereof, the electrostatic latent image recorded on the photoconductive surface 33 is developed by bringing the brush of developer mix into contact therewith.

Further details of the development apparatus which comprises development station C will be described later by specific reference to the present invention.

The developed image on the photoconductive surface 33 is then brought into contact with the sheet 36 of final support material within a transfer station D and the toner image is transferred from the photoconductive surface 33 to the contacting side of the final support sheet 36. The final support material may be paper, plastic, etc., as desired.

After the toner image has been transferred to the sheet of final support material 36 the sheet with the image thereon is advanced to a suitable fuser 37 which coalesces the transferred powder image thereto. One type of suitable fuser is described in U.S. Pat. No. 2,701,765, issued to Codichine et al in 1955. After the fusing process the sheet 36 is advanced to a suitable output device.

Although a preponderance of the toner powder is transferred to the final support material 36, invariably some residual toner remains on the photoconductive surface 33 after the transfer of the toner powder image to the final support material. The residual toner particles remaining on the photoconductive surface 33 after the transfer operation are removed from the drum 32 as it moves through a cleaning station E. The toner particles may be mechanically cleaned from the photoconductive surface 33 by any conventional means as, for example, the use of a blade as set forth in U.S. Pat. No. 3,740,789, issued to Ticknor in 1973.

It is believed that the foregoing description is sufficient for purposes of the present application to illustrate the general operation of an automatic xerographic copier 30 which can embody the magnetic brush flow baffles 20 and magnetic brush apparatus 31 in accordance with the present invention.

Referring again to the development apparatus 31 it includes a storage portion or sump 40 in a housing 41 for storing the developer material. The top of the housing may include an opening 42 that could have a removable cover or cap (not shown). The system could include toner dispenser (not shown) disposed over the opening which periodically dispenses toner into the housing in a manner similar to that taught in U.S. Pat. No. 3,608,792. Alternatively, the circulating system could be of the type where toner and/or toner plus carrier is added periodically by an operator or an attendant to the machine.

The development apparatus 31 includes magnetic brush rolls 42 and 43. The magnetic brush applicator roll 42 includes a rotatably mounted support member in the form of a cylindrical shell or sleeve 44 and a stationary permanent magnet 45 suspended within the sleeve. The magnetic field of the magnet is oriented to form a brush-like structure of the developer mix. The applicator roll 42 is immersed in the sump 40 of developer material which comprises ferromagnetic carrier particles and a toner colorant. The developer mix is picked up by the outer support surface of the roll 42 by means of a pick-up magnetic field generated by stationary magnet 46 suspended within the sleeve 44, and is formed into a brush-like structure for application to the photoconductive surface 33 for development of the latent electrostatic image presented thereon. While only one applicator roll 42 is shown, any number of applicator rolls could be employed as desired.

Continued rotation of the roll past the development zone brings the magnetic brush 47 into the field of a lifting magnetic brush roll 43. The lifting roll 43 attracts the developer mix from the magnetic brush applicator roll 42 and carries it upward to be deposited on a slide 48 from which it flows into a cross-mixer 49 for return to the sump 40. The lifting roll 43 is also a magnetic brush roll and comprises a cylindrical sleeve 50 rotatably supported in the housing 41 and a fixed permanent magnet 51 supported in a stationary position within the sleeve. It is also possible in accordance with this invention to employ any desired number of lifting rolls 43. Further details of the apparatus 31 of FIG. 1 can be gained from a consideration of the aforenoted U.S. Pat. No. 3,707,947. In accordance with this invention magnetic brush flow baffles 20 are provided to regulate the flow of developer at the end portions of the magnetic brush applicator roll 42.

Figure 3:
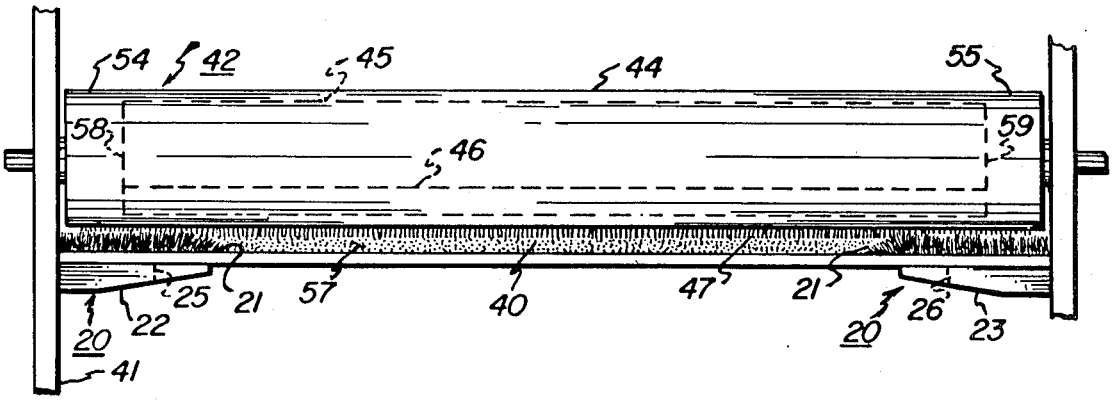
FIG. 3 is a partial front view in partial cross-section along the line 3—3 in FIG. 2.

Referring to FIGS. 2 and 3, the relative positions and structure of the magnetic brush flow baffles 20 in accordance with this invention are illustrated. As shown therein, the flow baffles 20 comprise stationary magnetic brushes 21 formed by means of the magnetic field generated by permanent magnets 22 and 23. The stationary magnetic brushes 21 extend inwardly from the housing 41 and inwardly of the development means which in the embodiment shown comprises the axial direction of the magnetic brush roll 42. The stationary magnetic brush baffles 20 are positioned between the supply means 52 and the development zone 53. They have a limited extension or width in the direction of movement of the mag brush roll 42. This is significant since it is apparent from the drawings that the baffles 20 do not act to seal the end portions 54 and 55 of the mag brush roll 42 from the developer mix. While they can reduce or eliminate the flow of developer mix on the end portions 54 and 55 of the roll 42 between the baffles 20 and the development zone 53, they are not so operative between the baffles 20 and the supply means 52.

In order to form the stationary magnetic brushes 21 in accordance with this invention, it is preferred to employ permanent magnets 22 and 23 extending out from the sides of the housing 41 and positioned externally of the housing. The magnets may be held in place by any desired means such as, for example, the use of spring clips 56 as shown. The field of each magnet 22 and 23 is oriented as shown to form stationary magnetic brushes 21 extending outwardly from the bottom of the housing 41 toward the applicator roll surface.

Figure 4:
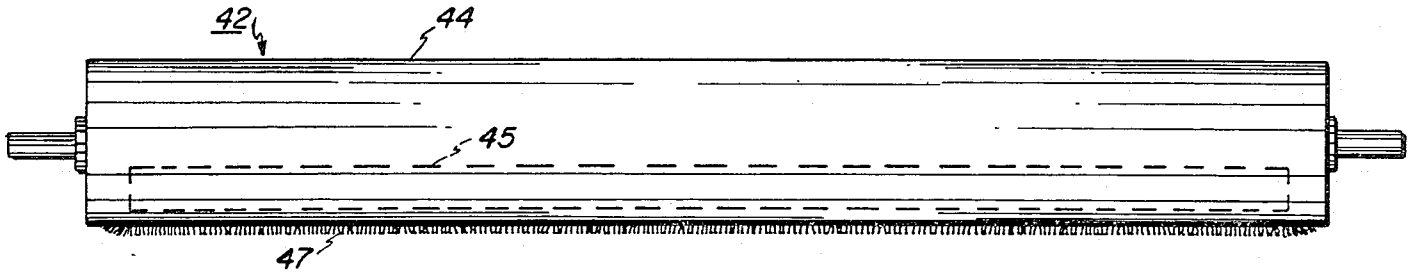
FIG. 4 is a top view in partial cross-section of a magnetic brush development means in accordance with this invention.

It is preferred in accordance with this invention that the stationary magnetic brushes 21 extend out from the housing 41 toward the roll 42 over less than the entire gap 57 between the housing and the roll. This type of a structure permits some developer flow at the end portions 54 and 55 of the roll 42. The amount of developer flow which is permitted should preferably be less than, or equal to, the rate of developer flow at the middle portion, in an axial sense, of the roll. This can result as shown in FIG. 4, in a substantially uniform magnetic brush 47 being formed over the entire operative length of the roll 42 or in one (not shown) with end portions of the brush having a reduced height as compared to the axial middle portion of the brush. Comparing FIG. 4 to FIG. 1, the effect of the magnetic brush flow baffles 20 of this invention is clearly illustrated, namely, the bulbous portions 11 and 12 of the brush 1 have been reduced to a height equal to or less than that of the brush at the axial middle of the roll 42.

Referring again to FIG. 3, it is apparent that the magnetic brush 47 on the surface of the roll is not formed over the entire axial length of the roll 42, but rather the length of the brush is dictated by the length of the magnets 45 and 46 within the roll. Since the magnetic brush flow baffles 20 of this invention are directed at eliminating the effect of the fringe fields at the ends of the magnet 45, it is preferred that they extend inwardly past the ends 58 and 59 of the magnet 45 a desired amount to offset the effect of the fringe fields.

In an exemplary embodiment a magnetic brush roll 42 approximately 15 inches long was employed having magnets 45 and 46 suspended therein of approximately 14 ½ inches long. The magnets 22 and 23, in accordance with this invention to provide the stationary magnetic brush baffles 20, were selected to be approximately 1 ¼ inches long. This specific example, however, is not meant to be limitative of the invention.

Figure 5:
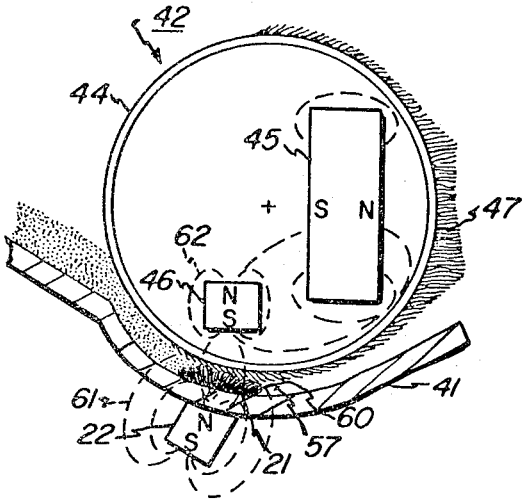
FIG. 5 is a partial cross-section of a magnetic brush apparatus having one embodiment of a flow baffle in accordance with this invention.

Referring to FIG. 5, a magnetic field arrangement in accordance with the preferred embodiment of this invention is shown. As shown in FIG. 5, the baffle forming magnet 22 has a magnetic field 61 associated therewith which is capable of forming a stationary magnetic brush 21. The stationary magnetic brush 21 does not extend, however, over the entire gap 57 between the roll surface 44 and the bottom of the housing 41 in order to allow developer material flow in the gap 60 between the brush 21 and the roll surface 44. In operation, the field 61 cooperates with the field 62 of the magnet 46 so that a magnetic brush will be formed over the entire gap 57 between the housing 41 and the roll surface 44 which is made up of two components. The first component will comprise the stationary brush 21 of this invention. The second component lies between the end of the stationary brush 21 and the roll surface 44 and comprises the moving magnetic brush 47 formed by the field associated with the pick-up magnet 46.

In accordance with an exemplary embodiment the field intensity of the stationary brush forming magnet 22 0.1 inches above the magnet was selected to be from about 260 to about 300 gauss. This should approximate the field intensity at the interior surface of the housing 41 adjacent the magnet 22. The field intensity of the pick-up magnet 46 measured about 0.060 inches below the applicator roll surface was approximately 150 gauss. The gap 57 was about 0.1 inches. In an apparatus employing these magnets a stationary magnetic brush was formed which did not extend over the entire gap 57 between the roll 42 and the interior of the housing 41.

Figure 6:
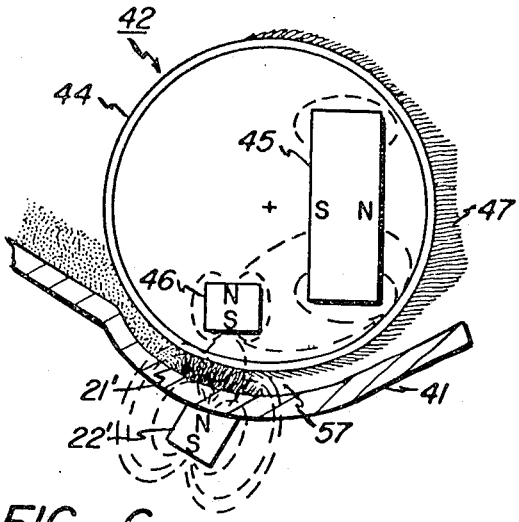
FIG. 6 is a partial cross-section of a magnetic brush apparatus having a flow baffle in accordance with a different embodiment of the present invention.

Referring now to FIG. 6, an alternative embodiment in accordance with the present invention is shown. In this embodiment the field strength of the stationary brush forming magnet 22' has been substantially increased to overcome the field of the pick-up magnet 46 so as to form a stationary brush over the entire gap 57 between the interior of the housing 41 and the roll surface 44. This type of baffle is not preferred in accordance with this invention, but is included in the broad scope of the invention. Referring again to FIG. 3, it is apparent that if a stationary baffle brush 21' is formed over the entire gap 57 between the interior of the housing 41 and the roll surface 44, the degree to which the stationary brushes project axially inwardly of the roll surface would have to be reduced. To provide axially shorter brushes 21' the magnets 22 and 23 would have to be reduced in length as shown in phantom by lines 25 and 26. In accordance with this embodiment the distance between the stationary brushes 21' in the axial direction of the roll would have to be sufficiently large to permit a development brush 47 to be formed having an operative length sufficient to cover the entire copy sheet 36.

While this embodiment would be operative to reduce developer flow at the ends 54 and 55 of the roll 42, it would not do so to the same degree as the embodiment of FIG. 5. This is because the fringe fields 7 and 8 extend into the operative length of the development brush 47. Therefore, by blocking off only that portion of the brush 47 which is not operative to develop the image, the ends of the brush will still include an increased developer flow due to the effect of the fringe fields, and, therefore, a somewhat increased background development as compared to the development by the axial center of the brush.

Figure 7A:
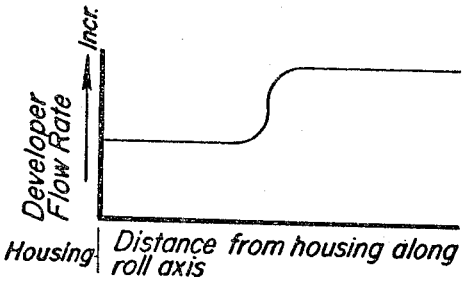
FIG. 7*a* and 7*b* comprise a graph and partial cross-section respectively illustrating the flow regulating effect of a stationary brush forming magnet in accordance with one embodiment of the invention.
Figure 7B:
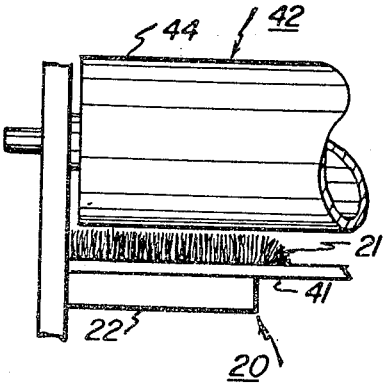

Referring now to FIGS. 7*a* and 7*b*, there is shown the effect of a stationary brush forming magnet 22 having a substantially uniform cross-section over its entire length. The stationary brush 21 formed by this magnet has a substantially uniform height over substantially the entire length of the magnet and the height then falls off very rapidly at the end of the magnet. This should result approximately, as shown in FIG. 7*a*, in a fairly abrupt change in developer flow rate along the length of the roll 42 and, therefore, in a corresponding abrupt change in the density of the developer in the brush 47 during development of the image and a noticeable corresponding abrupt change in the density of the image transferred to the copy sheet 36.

Figure 8A:
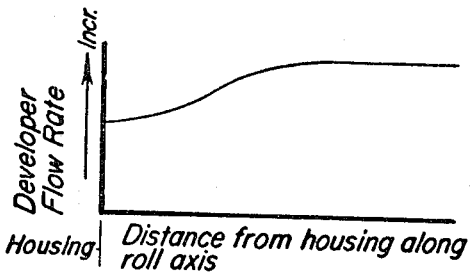
FIGS. 8*a* and 8*b* comprise a graph and partial cross-section respectively illustrating the flow regulating effect of a stationary brush forming magnet in accordance with a preferred embodiment of this invention.
Figure 8B:
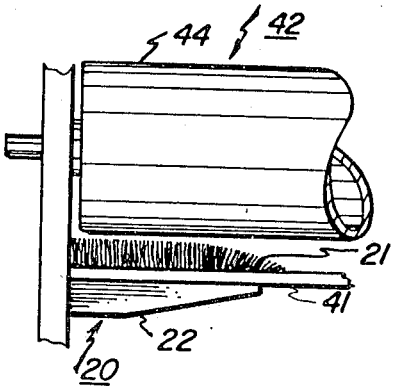

Referring to FIGS. 8*a* and 8*b*, there is shown a stationary brush forming magnet 22 which has a wedge shaped form wherein the thickness of the magnet decreases as the magnet projects inwardly of the applicator roll 42. The stationary brush 21 formed by this type of magnet 22 is illustrated in FIG. 8*b*. As shown therein, there is a gradual reduction in the height of the stationary brush 21 the further it extends inwardly of the development roll 42.

Referring to FIG. 8*a*, the flow rate of the developer is shown extending in from the housing 41. The flow rate shown changes gradually in substantial correspondence to the height of the stationary brush. This gradual change in flow rate allows the density of the developer in the development brush 47 to also change gradually so that the density change in the image on the copy sheet also changes more gradually, therefore, creating an acceptable appearance. Therefore, it is quite apparent from a consideration of FIGS. 7 and 8 that the use of a wedge shaped stationary brush forming magnet 22 and 23 is highly desirable and preferred in accordance with this invention.

It is also apparent that it is preferred in accordance with this invention to position the stationary brush forming magnets 22 and 23 externally of the housing 41. Positioning the magnets externally of the housing allows greater flexibility since one or both magnets could be changed in the event that developer flow at the ends of the roll 42 is not acceptable. If desired, however, the magnets can be positioned internally of the housing 41 or the magnetic brush rolls 42 and 43. This approach could well be used, for example, with stationary brushes 21' which extend over the entire gap 57 between the roll surface 44 and the housing 41.

While the stationary brushes flow baffles 21 have been described with reference to their use in conjunction with the applicator roll 42, they could be employed with other magnetic brush rolls, if desired.

It has been found desirable to provide impervious flow blocking members 70 as shown in FIG. 2. The members have a cross-section as shown and extend inwardly of the roll 42 an amount similar to the brushes 21' of the embodiment of FIG. 6. They are located between the supply means 52 and the baffles 20. The members 70 further improve the regulation of developer flow rate at the ends of the roll 42.

The patents and texts referred to specifically in this application are intended to be incorporated by reference into the application.

It is apparent that there has been provided in accordance with this invention, a support member, process and apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. In an electrostatographic reproducing apparatus including:

a moving imaging surface;

means for forming an electrostatic image on said surface;

a developer supply means;

a development means for developing said electrostatic image on said imaging surface by the application of developer thereto comprising a moving member for supporting a first magnetic brush of said developer;

first magnetic field generating means for forming said first magnetic brush so that it extends out from said moving member with a first height; and means for moving said member between said supply means and a development zone; the improvement wherein, said apparatus further includes:

means for reducing the height of said first magnetic brush, said height reducing means comprising a stationary member for supporting a second magnetic brush of said developer, said stationary member being spaced from said moving member and second magnetic field generating means for forming said second magnetic brush so that it extends out from said stationary member toward said moving member so as to engage said first magnetic brush to reduce said first height.

2. An apparatus as in claim 1, wherein said moving member extends across said imaging surface and has first and second opposing ends and first and second end portions extending inwardly from said ends.

3. An apparatus as in claim 2, wherein said first and second magnetic field generating means comprise permanent magnets.

4. An apparatus as in claim 3, further including a housing substantially enclosing said development means and having an opening at said development zone to provide communication between said first magnetic brush and said moving imaging surface and wherein said second magnetic field generating means is positioned externally of said housing.

5. An apparatus as in claim 4, wherein said stationary member comprises said housing.

6. An apparatus as in claim 2, wherein said second magnetic field generating means are positioned between said supply means and said development zone and extend inwardly of each of the ends of said development means a given amount and have a limited extension in the direction of movement of said development means whereby said second magnetic brushes as formed tend to limit the flow of developer at the end portions of said development means.

7. An apparatus as in claim 6, further including a housing substantially enclosing said development means and having an opening at said development zone to provide communication between said moving magnetic brush and said moving imaging surface, and wherein said second magnetic field generating means are positioned externally of said housing.

8. An apparatus as in claim 7, wherein said second magnetic field generating means comprise permanent magnets positioned at the ends of said housing.

9. An apparatus as in claim 8, wherein said permanent magnets have a wedge-shaped portion wherein the thickness of said magnets decreases the further said magnets extend inwardly of said development means.

10. An apparatus as in claim 9, further including flow blocking members extending inwardly of each of the ends of said development means said members being positioned between said supply means and said second magnetic field generating means.

11. An apparatus as in claim 2, further including means for transferring the developed image to a sheet of final support material.

12. An electrostatographic reproducing apparatus including:

a moving imaging surface;

means for forming an electrostatic image on said surface;

a developer means;

a development means for developing said electrostatic image on said imaging surface by the application of developer thereto comprising:

a moving member for supporting a first magnetic brush of said developer, said member having first and second opposing ends and first and second end portions extending inwardly from said ends;

a stationary member for supporting a second magnetic brush of said developer, said stationary member being spaced from said moving member so as to define a gap extending from said moving member to said stationary member;

first magnetic field generating means for forming said first magnetic brush so that it extends out from said moving member toward said stationary member in said gap;

second magnetic field generating means for forming said second magnetic brush so that it extends out from said stationary member toward said moving member over the entire of said gap, said second magnetic field generating means extending inwardly of the ends of said moving member a given amount and having a limited extension in the direction of movement of said member;

whereby said second magnetic brushes as formed tend to limit the flow of developer at the end portions of said member.

13. An apparatus as in claim 12, wherein said moving member extends across said image bearing surface, and further including means for moving said moving member between said supply means and a development zone.

14. An apparatus as in claim 13, further including a housing substantially enclosing said development means and having an opening at said development zone to provide communication between said first magnetic brush and said moving image bearing surface and wherein said second magnetic field generating means are positioned externally of said housing.

15. An apparatus as in claim 14, wherein said second magnetic field generating means comprise permanent magnets positioned at the ends of said housing.

16. An apparatus as in claim 15, wherein said permanent magnets have a wedge-shaped portion wherein the thickness of said magnets decreases the further said magnets extend inwardly of said development means.

17. An apparatus as in claim 16, further including flow blocking members extending inwardly of each of the ends of said development means said members being positioned between said supply means and said second magnetic field generating means.

* * * * *